US011164499B2

(12) United States Patent
Wang

(10) Patent No.: US 11,164,499 B2
(45) Date of Patent: Nov. 2, 2021

(54) COLOR TEMPERATURE ADJUSTMENT METHOD OF DISPLAY, ELECTRONIC DEVICE, AND COMPUTER READABLE STORAGE MEDIUM

(71) Applicant: SHENZHEN CHINA STAR OPTOELECTRONICS SEMICONDUCTOR DISPLAY TECHNOLOGY CO., LTD., Guangdong (CN)

(72) Inventor: Limin Wang, Guangdong (CN)

(73) Assignee: SHENZHEN CHINA STAR OPTOELECTRONICS SEMICONDUCTOR DISPLAY TECHNOLOGY CO., LTD., Guangdong (CN)

( * ) Notice: Subject to any disclaimer, the term of this patent is extended or adjusted under 35 U.S.C. 154(b) by 533 days.

(21) Appl. No.: 16/079,743

(22) PCT Filed: Jun. 13, 2018

(86) PCT No.: PCT/CN2018/090988
§ 371 (c)(1),
(2) Date: Aug. 24, 2018

(87) PCT Pub. No.: WO2019/128125
PCT Pub. Date: Jul. 4, 2019

(65) Prior Publication Data

US 2021/0097918 A1 Apr. 1, 2021

(30) Foreign Application Priority Data

Dec. 29, 2017 (CN) ..... 201711480852.5

(51) Int. Cl.
*G09G 3/20* (2006.01)

(52) U.S. Cl.
CPC ... *G09G 3/2003* (2013.01); *G09G 2320/0276* (2013.01); *G09G 2320/0666* (2013.01); *G09G 2320/0673* (2013.01)

(58) Field of Classification Search
CPC ..... G09G 3/2003; G09G 2320/0666; G09G 2320/0673; G09G 2320/0276
See application file for complete search history.

(56) References Cited

U.S. PATENT DOCUMENTS 8,681,073 B1 * 3/2014 Robbins ..... H04N 21/42202 345/7
9,087,489 B2 * 7/2015 Yamazaki ..... G02F 1/13318
(Continued)

FOREIGN PATENT DOCUMENTS

CN 104165753 A 11/2014
CN 106461991 A 2/2017
(Continued)

*Primary Examiner* — Sejoon Ahn
(74) *Attorney, Agent, or Firm* — Leong C. Lei

(57) ABSTRACT

The present disclosure relates to a color temperature adjustment method of a display. The display is a transparent display. The color temperature adjustment method includes: detecting current color temperature data of a background environment right behind the display, obtaining a color temperature compensation coefficient of the display, calculating a target color temperature of the display according to the color temperature data of the background environment and the color temperature compensation coefficient, obtaining a gamma voltage corresponding to the target color temperature, controlling the display to adjust the color temperature of the display to the target color temperature according to the obtained gamma voltage. The present disclosure further relates to a computer readable storage medium. As such, the color temperature of the transparent display may accurately be adjusted, and the user experience may be improved.

6 Claims, 8 Drawing Sheets

(56) References Cited

U.S. PATENT DOCUMENTS 9,965,898 B2 * 5/2018 Bean ..... G06T 15/503
10,262,568 B2 * 4/2019 Wang ..... G09G 3/2003
2002/0126106 A1 * 9/2002 Naito ..... H04N 5/7441 345/204
2009/0322678 A1 * 12/2009 Lashina ..... G06Q 30/02 345/158
2010/0165002 A1 * 7/2010 Ahn ..... G09G 3/3648 345/690
2010/0177025 A1 * 7/2010 Nagata ..... G09F 9/35 345/76
2014/0292825 A1 * 10/2014 Kim ..... G09G 3/3607 345/690
2014/0306984 A1 * 10/2014 Choi ..... G09G 5/06 345/591
2015/0268721 A1 * 9/2015 Joo ..... G06F 3/013 345/156
2015/0371579 A1 * 12/2015 Yu ..... G09G 3/2003 345/690
2016/0210097 A1 * 7/2016 Forutanpour ..... G06F 3/1423
2016/0240125 A1 * 8/2016 Sridharan ..... G09G 5/06
2017/0169749 A1 * 6/2017 Masuda ..... G09G 3/3413
2017/0229059 A1 * 8/2017 Bonnier ..... G06F 3/017
2018/0115734 A1 * 4/2018 Whang ..... H04N 21/47
2018/0293947 A1 * 10/2018 Kurokawa ..... G02F 1/1334
2018/0293958 A1 * 10/2018 Cote ..... G09G 3/20
2018/0295312 A1 * 10/2018 Cho ..... G09G 3/2007
2018/0330697 A1 * 11/2018 Lee ..... G09G 5/363
2018/0342188 A1 * 11/2018 Wang ..... G09G 3/2003
2018/0357943 A1 * 12/2018 Wang ..... G09G 3/006

FOREIGN PATENT DOCUMENTS

CN 107039018 A 8/2017
CN 107517368 A 12/2017
JP 2003-78920 A 3/2003

* cited by examiner

COLOR TEMPERATURE ADJUSTMENT METHOD OF DISPLAY, ELECTRONIC DEVICE, AND COMPUTER READABLE STORAGE MEDIUM

RELATED APPLICATIONS

The present application is a National Phase of International Application Number PCT/CN2018/090988, filed Jun. 13, 2018, and claims the priority of China Application No. 201711480852.5, filed Dec. 29, 2017.

FIELD OF THE INVENTION

The present disclosure relates to a transparent display field, and more particularly to a color temperature adjustment method of a display, an electronic device, and a computer readable storage medium.

BACKGROUND OF THE INVENTION

As an innovated display technology, the transparent display technology has been widely adopted. Users are able to view the background behind the display when the images are displayed. A better viewing experience may be provided, when comparing with the conventional display, by combining the displayed images and the background.

Color temperatures have a great influence on displaying quality of the displays. The color temperature of the conventional displays may be adjusted according to the user's preference, which may only consider the displaying performance, and is not suitable for the transparent displays. The conventional transparent displays have a fixed color temperature. When the color temperature of the environment changes, the color temperature of the conventional display is not able to be changed. Therefore, when the images and the background are simultaneously shown, there may be a large difference in the color temperature between the displayed images and the background, resulting in a poor user experience.

SUMMARY OF THE INVENTION

The present disclosure relates a color temperature adjustment method of a display and an electronic device thereof capable of solving the problem of how to accurately adjust a color temperature of a transparent display.

In one aspect, the present disclosure relates to a color temperature adjustment method of a transparent display, including: detecting current color temperature data of a background environment right behind the display; obtaining a color temperature compensation coefficient of the display; calculating a target color temperature of the display according to the color temperature data of the background environment and the color temperature compensation coefficient; obtaining a gamma voltage corresponding to the target color temperature; controlling the display to adjust the color temperature of the display to the target color temperature according to the obtained gamma voltage.

The step of detecting the current color temperature data of the background environment right behind the display further includes: detecting and calculating the color temperature compensation coefficient of the display in advance.

The step of detecting and calculating the color temperature compensation coefficient of the display in advance further includes: detecting first color temperature data of the background environment which is not obtained through the display; detecting second color temperature data of the background environment which is obtained through the display; determining the color temperature compensation coefficient according to the first color temperature data of the background environment and the second color temperature data of the background environment; and storing the color temperature compensation coefficient.

Before the step of detecting the current color temperature data of the background environment right behind the display further includes: receiving a mode selection with respect to the display, wherein the mode selection includes a display mode and a transparent mode; obtaining a predetermined gamma voltage and a fixed color temperature of the display when the display mode is selected; detecting the current color temperature data of the background environment right behind the display when the transparent mode is selected.

The color temperature data of the background environment includes R/G/B three color characteristic data of the background environment.

In the step of determining the color temperature compensation coefficient according to the first color temperature data of the background environment and the second color temperature data of the background environment, the color temperature compensation coefficient is obtained by calculating a ratio of the first color temperature data of the background environment to the second color temperature data of the background environment.

In another aspect, the present disclosure relates to an electronic device, including: a memory storage, a processor, an environment light detector, a display, and one or more display color temperature adjustment program stored in the memory storage; wherein the display is a transparent display, and the display color temperature adjustment programs are configured to be executed by the processor for detecting current color temperature data of a background environment right behind the display; obtaining a color temperature compensation coefficient of the display; calculating a target color temperature of the display according to the color temperature data of the background environment and the color temperature compensation coefficient; obtaining a gamma voltage corresponding to the target color temperature; controlling the display to adjust the color temperature of the display to the target color temperature according to the obtained gamma voltage.

The display color temperature adjustment programs are further configured to be executed by the processor for: detecting first color temperature data of the background environment which is not obtained through the display; detecting second color temperature data of the background environment which is obtained through the display; determining the color temperature compensation coefficient according to the first color temperature data of the background environment and the second color temperature data of the background environment; and storing the color temperature compensation coefficient.

The display color temperature adjustment programs are further configured to be executed by the processor for receiving a mode selection with respect to the display, wherein the mode selection includes a display mode and a transparent mode; obtaining a predetermined gamma voltage and a fixed color temperature of the display when the display mode is selected; detecting the current color temperature data of the background environment right behind the display when the transparent mode is selected.

In another aspect, the present disclosure relates to a computer readable storage medium, wherein the computer readable storage medium is configured to store one or more display color temperature adjustment program, and the display color temperature adjustment programs are executed by at least one processor to perform the steps of the color temperature adjustment method.

In view of the above, the present disclosure provided the color temperature adjustment method of the display, the electronic device, and the computer readable storage medium capable of detecting and calculating the color temperature compensation coefficients for the transparent display in advance, storing the color temperature compensation coefficient corresponding to the display, increasing the consideration of the color temperature compensation coefficient when calculating the color temperature of the environment, determining the target color temperature of the display according to the color temperature data of the background environment and the color temperature compensation coefficient, and selecting the gamma voltage according to the target color temperature. As such, the color temperature of the display may be adjusted to the target color temperature, so as to improve accuracy of the color temperature detection of the display under the transparent mode, the color temperature adjustment under the transparent mode, and the user experience.

The implementation, functional features, and advantages of the purpose of the present disclosure will be further described with reference to the accompanying drawings.

DETAILED DESCRIPTION OF PREFERRED EMBODIMENTS

The following descriptions for the respective embodiments are specific embodiments capable of being implemented for illustrations of the present invention with referring to appended figures.

In the following description, the use of "module", "component" or "unit" indicating an element is merely an explanation for facilitating the present disclosure, and has no specific meaning. Therefore, "module", "part" or "unit" can be used in combination.

In one aspect, the present disclosure relates to an electronic device configured to adjust a color temperature of a transparent display according to a color temperature compensation coefficient, so as to improve user experience.

Figure 1:
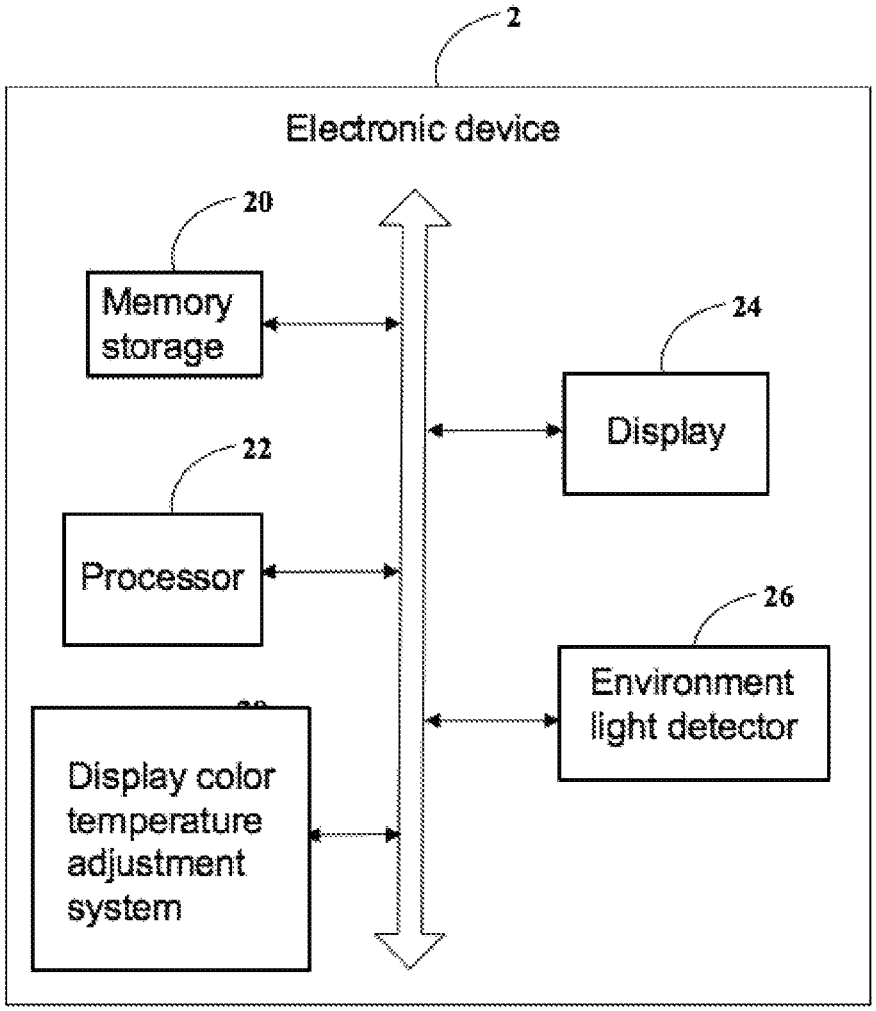
FIG. 1 is a diagram of an electronic device in accordance with one embodiment of the present disclosure.
Figure 2:
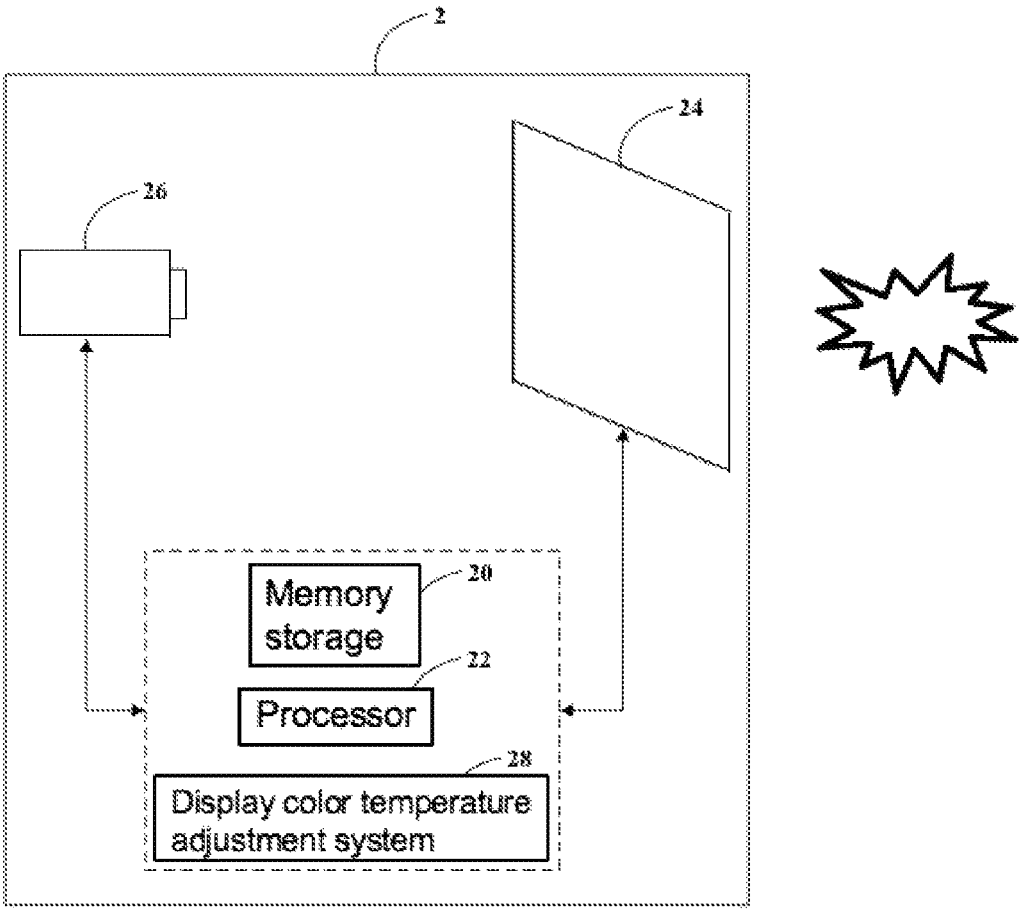
FIG. 2 is a diagram illustrating an application scenario of the electronic device.

Referring to FIG. 1 and FIG. 2, the present disclosure relates to an electronic device 2. The electronic device 2 includes a memory storage 20, a processor 22, a display 24, an environment light detector 26, and a display color temperature adjustment system 28.

In one example, the memory storage 20 may include at least one kind of a computer readable storage medium configured to store an operation system and a variety of applications installed in the electronic device 2. For example, programming codes of the display color temperature adjustment system 28. In another example, the memory storage 20 is further configured to temporarily store various types of data that have been outputted or the data about to be outputted.

In some examples, the processor 22 may be central processing unit (CPU), controller, microcontroller, microprocessor, or other data processing chip. The processor 22 is configured to control an overall operation of the electronic device 2. In one example, the processor 22 is configured to operate the programming code or processing data stored in the memory storage 20, such as operating the display color temperature adjustment system 28.

In one example, the display 24 may be a transparent display, such as a liquid crystal display (LCD) or an organic light-emitting diode (OLED) transparent display, configured to display and receive a touch operation from users.

In one example, the environment light detector 26 is configured in a front of the display 24, and is configured to detect color temperature data of a background environment right behind the display 24, as shown in FIG. 2.

Those skilled in the art can understand that a structure shown in FIG. 1 does not constitute a limitation on the electronic device 2, and the electronic device 2 may further include other necessary components, or may combine with some components, or may have different component arrangements.

Figure 3:
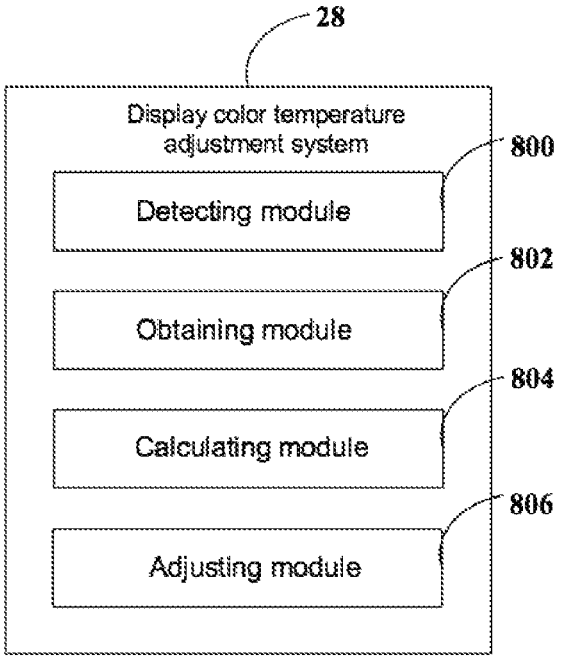
FIG. 3 is a diagram illustrating a display color adjustment system in accordance with one embodiment of the present disclosure.

In one example, as shown in FIG. 3, the present disclosure relates to the display color temperature adjustment system 28, and the display color temperature adjustment system 28 may include a detecting module 800, an obtaining module 802, a calculating module 804, and an adjusting module 806.

The detecting module 800 is configured to control the environment light detector 26 to detect the current color temperature data of the background environment right behind the display 24.

Figure 8:
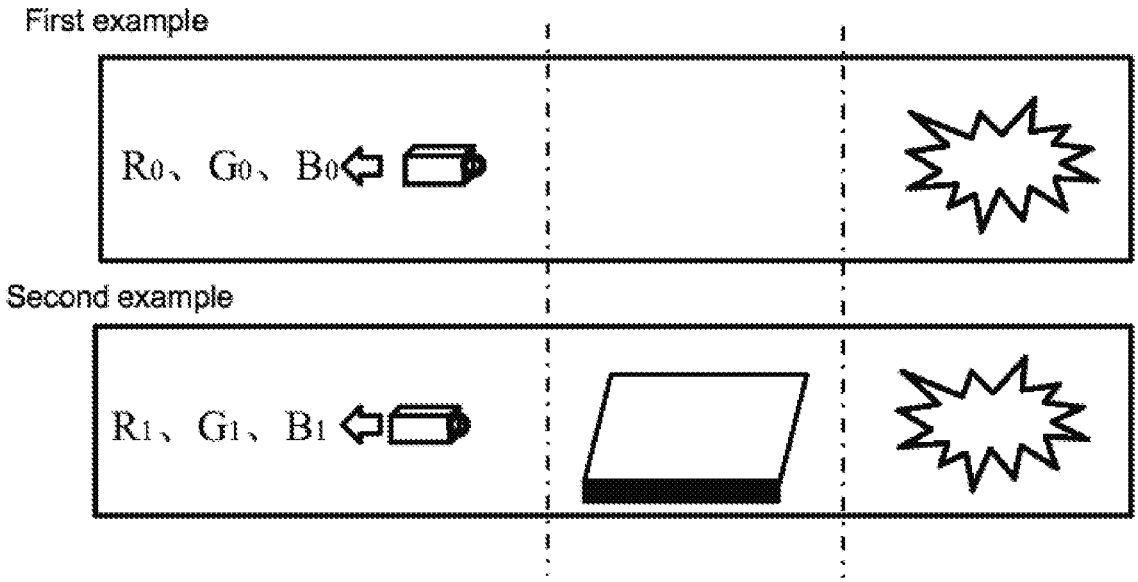
FIG. 8 is a diagram illustrating an operation of detecting the color temperature of a background environment.

Specifically, when the color temperature of the display 24 requires to be adjusted, the detecting module 800 may control the environment light detector 26 to detect the color temperature data of the background environment right behind the display 24 (i.e., the environment color temperature data is not obtained through the display 24 in this example, and may refer to the first example shown in FIG. 8). In one example, the color temperature data of the background environment may include R/G/B three color characteristic data of the background environment.

The obtaining module 802 is configured to obtain the color temperature compensation coefficient of the display 24.

Specifically, the memory storage 20 of the electronic device 2 is configured to store the color temperature compensation coefficient corresponding to the display 24 in advance. The color temperature compensation coefficient is to compensate for a difference between a detected color temperature of the background environment and a color temperature viewed toward the display 24, such that a color temperature adjustment of the display 24 may be more accurate. The color temperature compensation coefficient is related to a design of the display 24, and different color temperature compensation coefficients may correspond to different displays 24.

The calculating module 804 is configured to calculate a target color temperature of the display 24 according to the color temperature data of the background environment and the color temperature compensation coefficient.

Specifically, since the color temperature data of the background environment is not obtained through the display 24, it is necessary to combine the color temperature compensation coefficient to obtain the color temperature of background environment that the users view through the display 24. That is, the calculating module 804 is configured to calculate and obtain the color temperature that the display 24 requires to be adjusted to, i.e., the target color temperature, according to the color temperature data of the background environment and the color temperature compensation coefficient.

The obtaining module 802 is further configured to obtain a gamma voltage corresponding to the target color temperature.

Specifically, the memory storage 20 of the electronic device 2 is further configured to store a correspondence table of each target color temperature of the display 24 and the corresponding gamma voltage values. When the calculating module 804 obtains the target color temperature, the obtaining module 802 is configured to query the correspondence table to obtain the gamma voltage corresponding to the target color temperature.

The adjusting module 806 is configured to control the display 24 to adjust the color temperature to the target color temperature according to the obtained gamma voltage.

Specifically, after obtaining the gamma voltage corresponding to the target color temperature, the adjusting module 806 is configured to output controlling signals corresponding to the gamma voltage, such that the color temperature of the display 24 may be adjusted to the target color temperature by the control signals.

In one example, referring to FIG. 3, the present disclosure further relates to the display color temperature adjustment system 28. The display color temperature adjustment system 28 is further configured to detect and calculate the color temperature compensation coefficient in advance. The display color temperature adjustment system 28 may include the detecting module 800 and the calculating module 804.

The detecting module 800 is configured to detect first color temperature data of the background environment which is not obtained through the display 24, and to detect second color temperature data of the background environment which is obtained through the display 24.

Specifically, before the display 24 is in use, the color temperature compensation coefficient of the display 24 may be obtained in advance through a series of detections and calculations for the adjustment of the color temperature of the display 24. Referring to the first example shown in FIG. 8, the detecting module 800 is configured to control the environment light detector 26 to detect the first color temperature data of the background environment right behind the display 24, which is not obtain through the display 24. Referring to the second example shown in FIG. 8, the detecting module 800 is further configured to control the environment light detector 26 to detect the second color temperature data of the background environment right behind the display 24 which is obtained through the display 24.

In one example, the first and second color temperature data of the background environment may include the R/G/B three color characteristic data of For example, the first color temperature data of the background environment, which is not obtained through the display 24, may include the color characteristic data $R_0$, $G_0$, and $B_0$, and the second color temperature data of the background environment, which is obtained through the display 24, may include the color characteristic data $R_1$, $G_1$, and $B_1$.

The calculating module 804 is further configured to determine the color temperature compensation coefficient according to the first color temperature data of the background environment and the second color temperature data of the background environment.

Specifically, the calculating module 804 is configured to determine the color temperature compensation coefficient according to a ratio of the first color temperature data of the background environment to the second color temperature data of the background environment. The color temperature compensation coefficient may be stored in the storage memory 20. When the first color temperature data of the background environment and the second color temperature data of the background environment are configured to be the R/G/B three color characteristic data of the background environment, the color temperature compensation data is configured to be a ratio of results before detection to results after the detection of each single color. For example, the first color temperature data of the background environment is configured to be $R_0$, $G_0$, and $B_0$, and the second color temperature data of the background environment is configured to be $R_1$, $G_1$, and $B_1$. The calculating module 804 is configured to obtain the color temperature compensation coefficient $\alpha_R$, $\alpha_G$, and $\alpha_B$ according to a ratio of the data before the detection to the date after the detection of each single color.

It is noted that in another example, a plurality of sets of the first color temperature data of the background environment and the second color temperature data of the background environment may be detected, and the color temperature compensation coefficient may be obtained by synthesizing (for example, averaging) the ratios of the plurality of sets of the first color temperature data of the background environment and the second color temperature data of the background environment. As such, the color temperature compensation coefficient may be more accurate.

Figure 4:
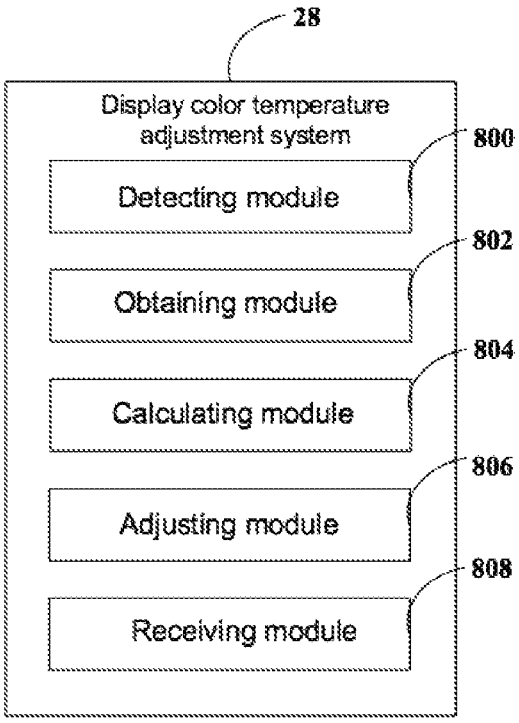
FIG. 4 is a diagram illustrating the display color adjustment system in accordance with another embodiment of the present disclosure.

In one example, referring to FIG. 4, the present disclosure relates to the display color temperature adjustment system 28, and the display color temperature adjustment system 28 may include the detecting module 800, the obtaining module 802, the calculating module 804, the adjusting module 806, and a receiving module 808.

The receiving module 808 is configured to receive a mode selection with respect to the display 24 from the users.

Specifically, the mode selection may include a display mode and a transparent mode. The mode selection may be completed by conducting the touch operation on the display 24 or by other inputting methods. When the display mode is selected, the obtaining module 802 is configured to obtain a predetermined gamma voltage and a fixed color temperature of the display 24. The adjusting module 806 is configured to adjust the color temperature to the fixed color temperature according to the predetermined gamma voltage. When the transparent mode is selected, the detecting module 800, the obtaining module 802, the calculating module 804, and the adjusting module 806 are respectively configured to perform functions described in above.

In another aspect, the present disclosure further relates to a color temperature adjustment method of the displays, which may be adopted to the electronic device 2, configured to adjust the color temperature of the transparent display according to the color temperature compensation coefficient, so as to improve the user experience.

Figure 5:
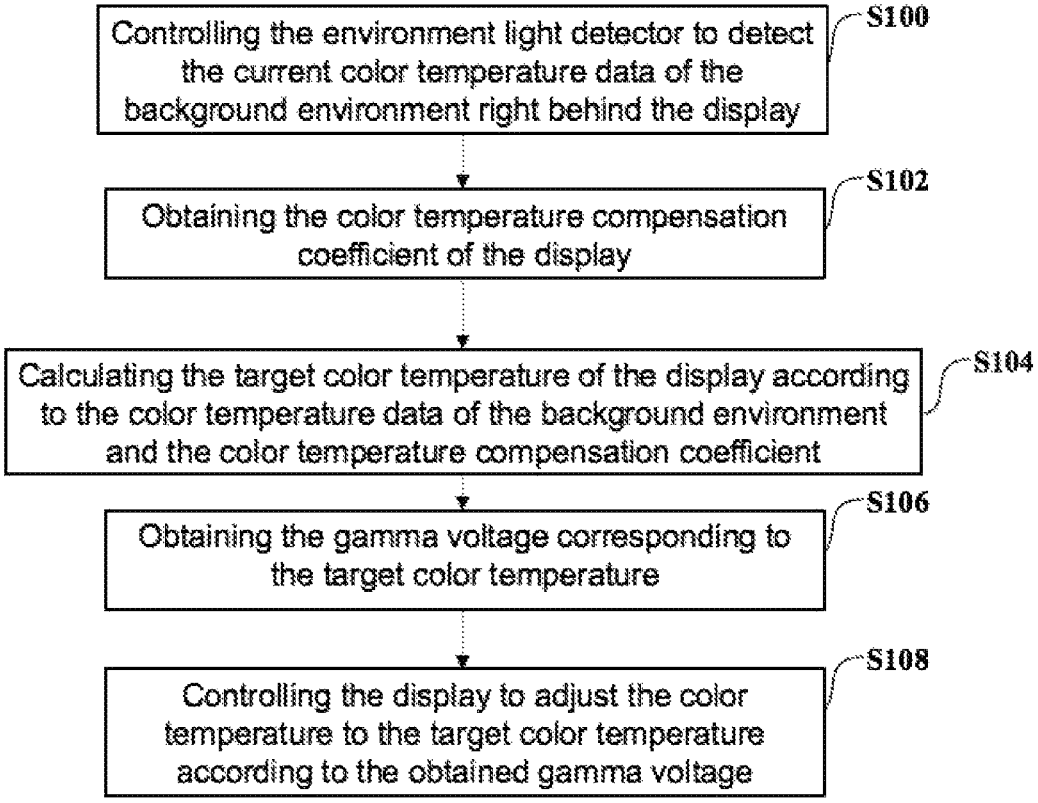
FIG. 5 is a flowchart illustrating a color temperature adjustment method of a display in accordance with one embodiment of the present disclosure.

In one example, referring to FIG. 5, the present disclosure relates to the color temperature adjustment method of the displays, including the following steps.

In step S100, controlling the environment light detector 26 to detect the current color temperature data of the background environment right behind the display 24.

Specifically, when the color temperature of the display 24 requires to be adjusted, the detecting module 800 may control the environment light detector 26 to detect the color temperature data of the background environment right behind the display 24 (i.e., the environment color temperature data is not obtained through the display 24 in this example, and may refer to the first example shown in FIG. 8). In one example, the color temperature data of the background environment may include the R/G/B three color characteristic data of the background environment.

In step S102, obtaining the color temperature compensation coefficient of the display 24.

Specifically, the memory storage 20 of the electronic device 2 is configured to store the color temperature compensation coefficient corresponding to the display 24 in advance. The color temperature compensation coefficient is to compensate for the difference between the detected color temperature of the background environment and the color temperature viewed toward the display 24, such that the color temperature adjustment of the display 24 may be more accurate. The color temperature compensation coefficient is related to the design of the display 24, and different color temperature compensation coefficients are corresponding to different displays 24.

In step S104, calculating the target color temperature of the display 24 according to the color temperature data of the background environment and the color temperature compensation coefficient.

Specifically, since the color temperature data of the background environment is not obtained through the display 24, it is necessary to combine the color temperature compensation coefficient to obtain the color temperature of background environment that the users view through the display 24. That is, the calculating module 804 is configured to calculate and obtain the color temperature that the display 24 requires to be adjusted to, i.e., the target color temperature, according to the color temperature data of the background environment and the color temperature compensation coefficient.

In step S106, obtaining the gamma voltage corresponding to the target color temperature.

Specifically, the memory storage 20 of the electronic device 2 is further configured to store the correspondence table of each target color temperature of the display 24 and the corresponding gamma voltage values. When the calculating module 804 obtains the target color temperature, the obtaining module 802 is configured to query the correspondence table to obtain the gamma voltage corresponding to the target color temperature.

In step S108, controlling the display 24 to adjust the color temperature to the target color temperature according to the obtained gamma voltage.

Specifically, after obtaining the gamma voltage corresponding to the target color temperature, the adjusting module 806 is configured to output the controlling signals corresponding to the gamma voltage, such that the color temperature of the display 24 may be adjusted to the target color temperature by the control signals.

Figure 6:
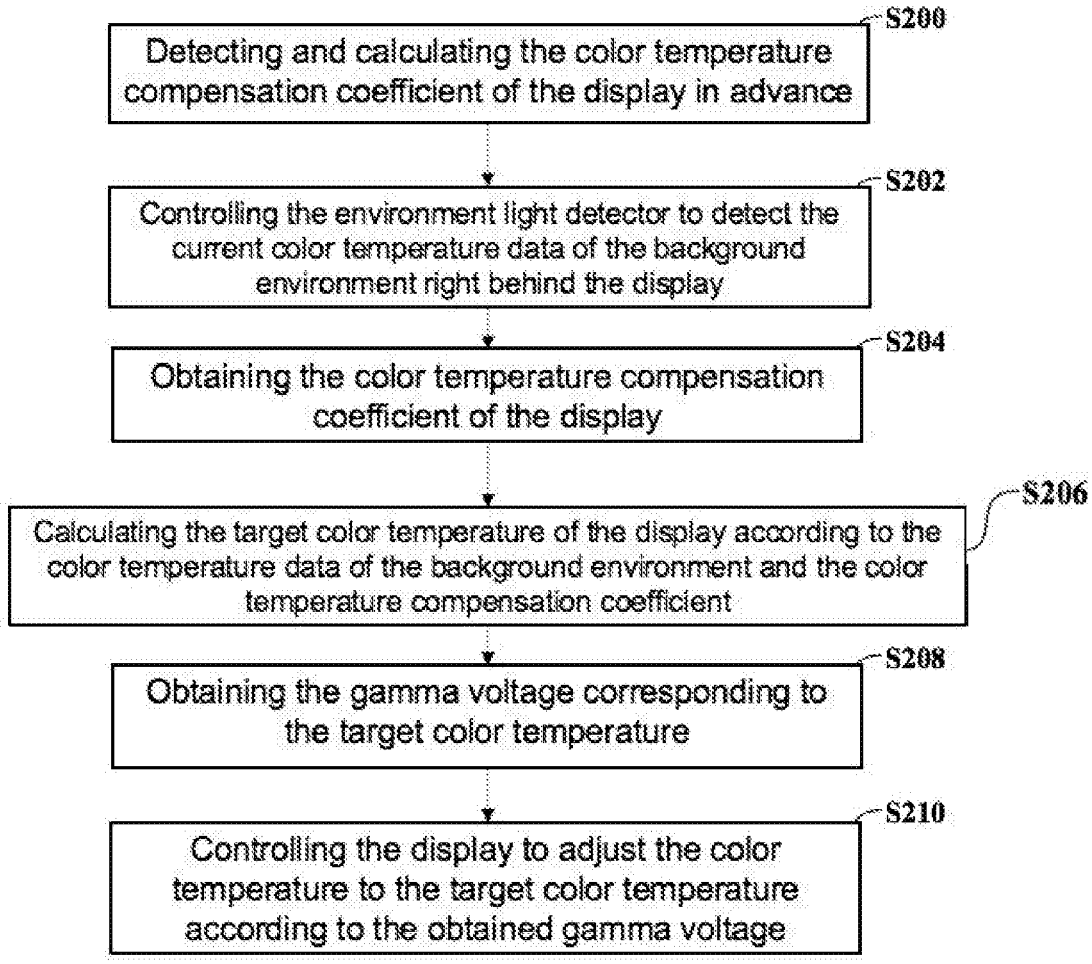
FIG. 6 is a flowchart illustrating the color temperature adjustment method of the display in accordance with another embodiment of the present disclosure.

In one example, referring to FIG. 6, the present disclosure relates to the color temperature adjustment method of the displays. The steps S202-S210 of the color temperature adjustment method in this example is similar to the steps S100-S108 in the previous example. The color temperature adjustment method further include the following steps.

In step S200, detecting and calculating the color temperature compensation coefficient of the display 24 in advance.

Figure 7:
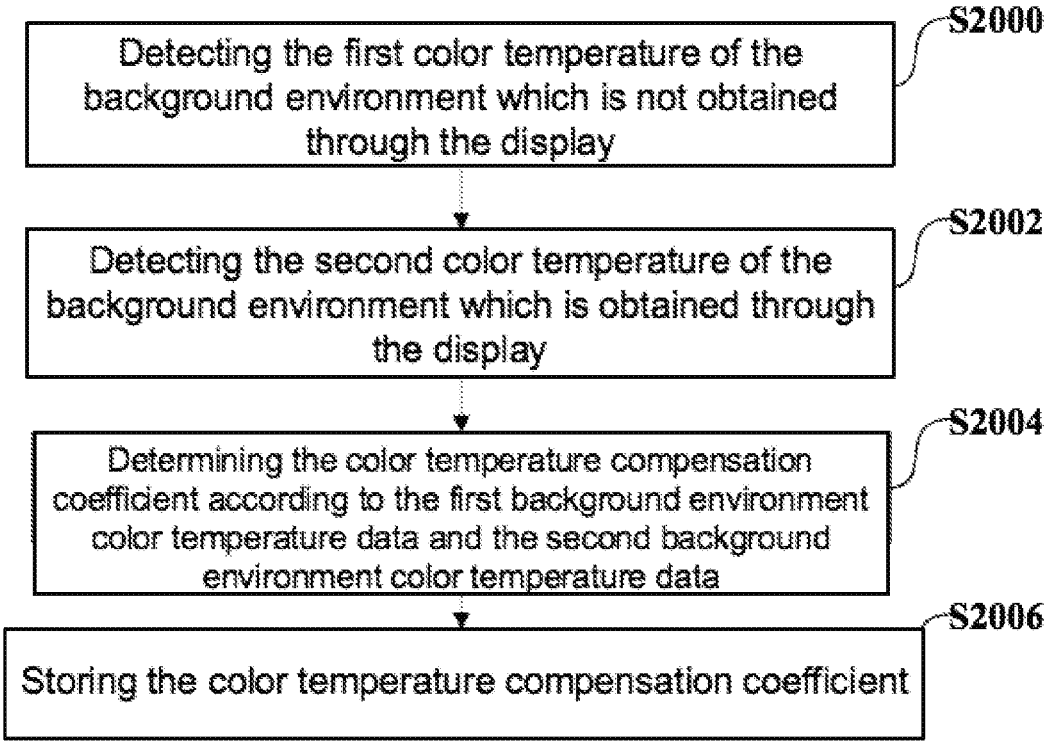
FIG. 7 is a flowchart illustrating the detail of a step S200 shown in FIG. 6.

Specifically, referring to FIG. 7, the step S200 further includes the following steps.

In step S2000, detecting the first color temperature data of the background environment which is not obtained through the display 24.

Specifically, before the display 24 is in use, the color temperature compensation coefficient of the display 24 may be obtained in advance through the series of the detections and the calculations for the adjustment of the color temperature of the display 24. Referring to the first example shown in FIG. 8, the detecting module 800 is configured to control the environment light detector 26 to detect the first color temperature data of the background environment right behind the display 24, which is not obtain through the display 24.

In one example, the first color temperature data of the background environment may include the R/G/B three color characteristic data of the background environment. For example, the first color temperature data of the background environment, which is not obtained through the display 24, may include the color characteristic data $R_0$, $G_0$, and $B_0$.

In step S2002, detecting the second color temperature data of the background environment which is obtained through the display 24.

Referring to the second example shown in FIG. 8, the detecting module 800 is further configured to control the environment light detector 26 to detect the second color temperature data of the background environment right behind the display 24 which is obtained through the display 24. In one example, the second color temperature data of the background environment may include the R/G/B three color characteristic data of the background environment. For example, the second color temperature data of the background environment, which is obtained through the display 24, may include the color characteristic data $R_1$, $G_1$, and $B_1$.

In step S2004, determining the color temperature compensation coefficient according to the first color temperature data of the background environment and the second color temperature data of the background environment.

Specifically, the calculating module 804 is configured to obtain the color temperature compensation coefficient according to the ratio of the first color temperature data of the background environment to the second color temperature data of the background environment. The color temperature compensation coefficient may be stored in the storage memory 20. When the first color temperature data of the background environment and the second color temperature data of the background environment are configured to be the R/G/B three color characteristic data of the background environment, the color temperature compensation data is configured to be the ratio of the results before the detection to the results after the detection of each single color. For example, the first color temperature data of the background environment is configured to be $R_0$, $G_0$, and $B_0$, and the second color temperature data of the background environment is configured to be $R_1$, $G_1$, and $B_1$. The calculating module 804 is configured to obtain the color temperature compensation coefficient $\alpha_R$, $\alpha_G$, and $\alpha_B$ according to the ratio of the data before the detection to the data after the detection of each single color.

It is noted that in another example, the plurality of sets of the first color temperature data of the background environment and the second color temperature data of the background environment may be detected, and the color temperature compensation coefficient may be obtained by synthesizing (for example, averaging) the ratios of the plurality of sets of the first color temperature data of the background environment and the second color temperature data of the background environment. As such, the color temperature compensation coefficient may become more accurate.

In step S2006, storing the color temperature compensation coefficient.

Specifically, the memory storage 20 is configured to store the obtained color temperature compensation coefficient.

Referring to FIG. 6, in step S202, controlling the environment light detector 26 to detect the current color temperature data of the background environment right behind the display 24.

Specifically, when the color temperature of the display 24 requires to be adjusted, the detecting module 800 may control the environment light detector 26 to detect the color temperature data of the background environment right behind the display 24 (i.e., the environment color temperature data is not obtained through the display 24, and may refer to the first example shown in FIG. 8). In one example, the color temperature data of the background environment may include the R/G/B three color characteristic data of the background environment.

In step S204, obtaining the color temperature compensation coefficient of the display 24.

Specifically, the memory storage 20 of the electronic device 2 is configured to store the color temperature compensation coefficient corresponding to the display 24 in advance. The color temperature compensation coefficient is to compensate for the difference between the detected color temperature of the background environment and the color temperature viewed toward the display 24, such that the color temperature adjustment of the display 24 may be more accurate. The color temperature compensation coefficient is related to the design of the display 24, and different color temperature compensation coefficients are corresponding to different displays 24.

In step S206, calculating the target color temperature of the display 24 according to the color temperature data of the background environment and the color temperature compensation coefficient.

Specifically, since the color temperature data of the background environment is not obtained through the display 24, it is necessary to combine the color temperature compensation coefficient to obtain the color temperature of background environment that the users view through the display 24. That is, the calculating module 804 is configured to calculate and obtain the color temperature that the display 24 requires to be adjusted to, i.e., the target color temperature, according to the color temperature data of the background environment and the color temperature compensation coefficient.

In step S208, obtaining the gamma voltage corresponding to the target color temperature.

Specifically, the memory storage 20 of the electronic device 2 is further configured to store the correspondence table of each target color temperature of the display 24 and the corresponding gamma voltages value. When the calculating module 804 obtains the target color temperature, the obtaining module 802 is configured to query the correspondence table to obtain the gamma voltage corresponding to the target color temperature.

In step S210, controlling the display 24 to adjust the color temperature to the target color temperature according to the obtained gamma voltage.

Specifically, after obtaining the gamma voltage corresponding to the target color temperature, the adjusting module 806 is configured to output the controlling signals corresponding to the gamma voltage, such that the color temperature of the display 24 may be adjusted to the target color temperature by the control signals.

Figure 9:
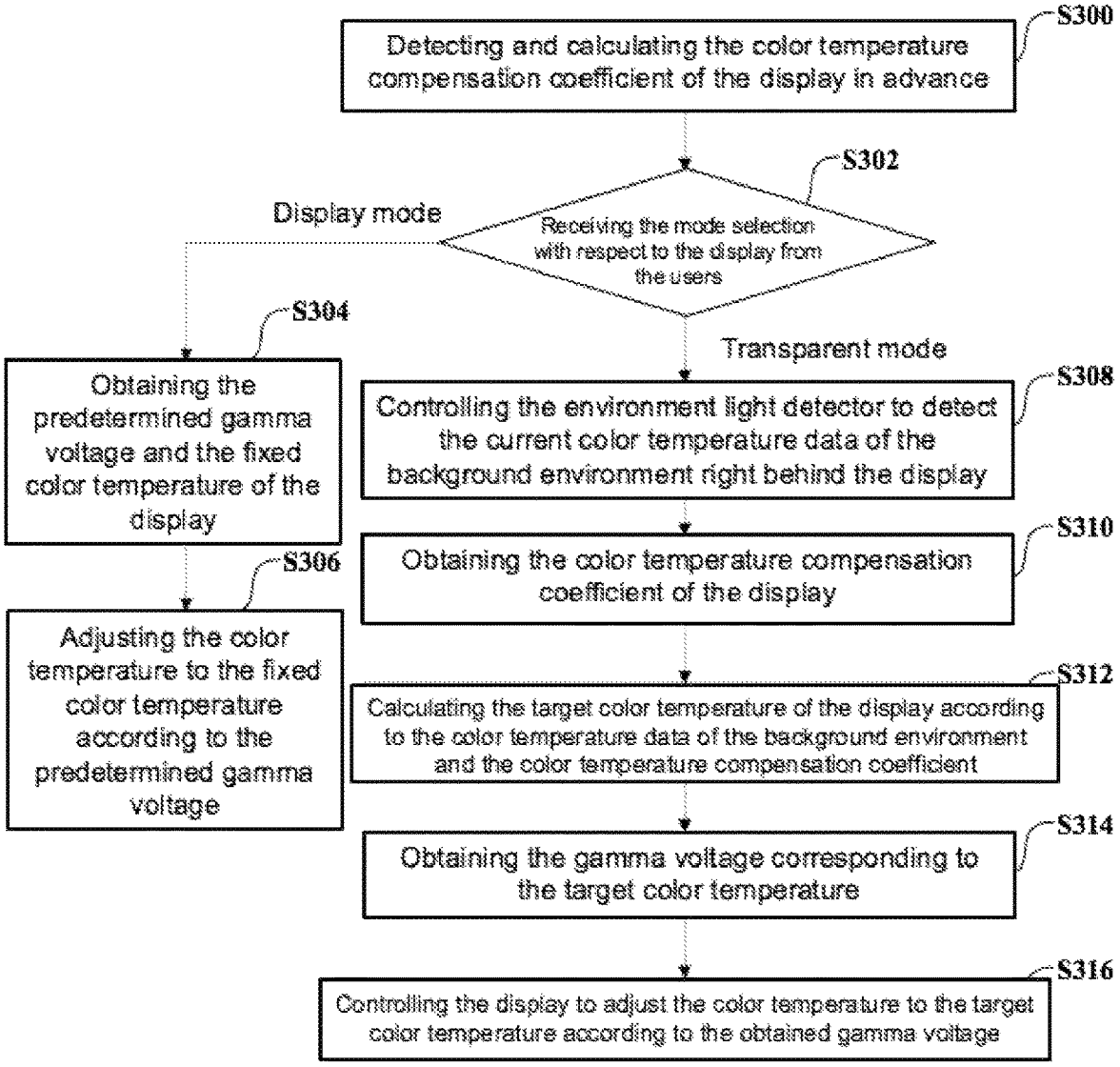
FIG. 9 is a flowchart illustrating the color temperature adjustment method of the display in accordance with another embodiment of the present disclosure.

In one example, referring to FIG. 9, the present disclosure further relates to the color temperature adjustment method of the displays. Step S300 and steps S308-S316 in this example are similar to the steps S200-S210 in the previous example. The color temperature adjustment method further include the following steps.

In step S300, detecting and calculating the color temperature compensation coefficient of the display 24 in advance.

Specifically, referring to FIG. 7, the detail description may not be repeated again.

In step S302, receiving the mode selection with respect to the display 24 from the users.

Specifically, the mode selection may include the display mode and the transparent mode. The mode selection may be completed by conducting the touch operation on the display 24 or by other inputting methods. When the display mode is selected, steps S304-S306 may be performed. When the transparent mode is selected, steps S308-S316 may be performed.

In step S304, obtaining the predetermined gamma voltage and the fixed color temperature of the display 24.

Specifically, the predetermined gamma voltage and the fixed color temperature corresponding to the display 24, which are stored in the memory storage 20 in advance, may be obtained from the memory storage 20.

In step S306, adjusting the color temperature to the fixed color temperature according to the predetermined gamma voltage.

Specifically, after obtaining the gamma voltage corresponding to the target color temperature, the adjusting module 806 is configured to output the controlling signals corresponding to the gamma voltage, such that the color temperature of the display 24 may be adjusted to the target color temperature by the control signals.

In step S308, controlling the environment light detector 26 to detect the current color temperature data of the background environment right behind the display 24.

Specifically, when the color temperature of the display 24 requires to be adjusted, the detecting module 800 may control the environment light detector 26 to detect the color temperature data of the background environment right behind the display 24 (i.e., the environment color temperature data is not obtained through the display 24, and may refer to the first example shown in FIG. 8). In one example, the color temperature data of the background environment may include the R/G/B three color characteristic data of the background environment.

In step S310, obtaining the color temperature compensation coefficient of the display 24.

Specifically, the memory storage 20 of the electronic device 2 is configured to store the color temperature compensation coefficient corresponding to the display 24 in advance. The color temperature compensation coefficient is to compensate for the difference between the detected color temperature of the background environment and the color temperature viewed toward the display 24, such that the color temperature adjustment of the display 24 may be more accurate. The color temperature compensation coefficient is related to the design of the display 24, and different color temperature compensation coefficients are corresponding to different displays 24.

In step S312, calculating the target color temperature of the display 24 according to the color temperature data of the background environment and the color temperature compensation coefficient.

Specifically, since the color temperature data of the background environment is not obtained through the display 24, it is necessary to combine the color temperature compensation coefficient to obtain the color temperature of background environment that the users view through the display 24. That is, the calculating module 804 is configured to calculate and obtain the color temperature that the display 24 requires to be adjusted to, i.e., the target color temperature, according to the color temperature data of the background environment and the color temperature compensation coefficient.

In step S314, obtaining the gamma voltage corresponding to the target color temperature.

Specifically, the memory storage 20 of the electronic device 2 is further configured to store the correspondence table of each target color temperature of the display 24 and the corresponding gamma voltage values. When the calculating module 804 obtains the target color temperature, the obtaining module 802 is configured to query the correspondence table to obtain the gamma voltage corresponding to the target color temperature.

In step S316, controlling the display 24 to adjust the color temperature to the target color temperature according to the obtained gamma voltage.

Specifically, after obtaining the gamma voltage corresponding to the target color temperature, the adjusting module 806 is configured to output the controlling signals corresponding to the gamma voltage, such that the color temperature of the display 24 may be adjusted to the target color temperature by the control signals.

In another aspect, the present disclosure further relates to a computer readable storage medium. The computer readable storage medium is configured to store one or more display color temperature adjustment program, and the display color temperature adjustment program can be executed by at least one processor to perform the steps of the color temperature adjustment method of the display as described above.

It is noted that the term, such as "comprises", "comprising", or any other variants, is intended to encompass a non-exclusive inclusion, such that a process, a method, an article, or a device, which includes a series of elements, may include those elements. It may also include other elements that are not explicitly listed, or elements that are inherent to such process, method, article, or device. An element defined by the phrase "comprising a . . . " does not exclude the presence of the same element in the process, method, article, or device that includes the element.

The serial numbers of the embodiments of the present disclosure are merely for the description, and do not represent the advantages and disadvantages of the embodiments.

In view of the embodiments described above, those persons skilled in the art can conceive that the present disclosure may be implemented by software together with hardware platform. Based on such understanding, the technical features of the present disclosure and the contribution to the prior art may be embodied in the form of a software product. The software product may be stored in a storage medium, such as ROM/RAM, disk, CD-ROM, including a plurality of instructions that can be executed by a computer device, which may be a personal computer, a server, or network equipment, so as to execute the method or the various embodiments of the present disclosure.

Above are embodiments of the present disclosure, which does not limit the scope of the present disclosure. Any equivalent amendments within the spirit and principles of the embodiment described above should be covered by the protected scope of the invention.

What is claimed is:

1. A color temperature adjustment method of a transparent display, comprising:

detecting current color temperature data of a background environment right behind a display;

obtaining a color temperature compensation coefficient of the display;

calculating a target color temperature of the display according to the color temperature data of the background environment and the color temperature compensation coefficient;

obtaining a gamma voltage corresponding to the target color temperature;

controlling the display to adjust the color temperature of the display to the target color temperature according to the obtained gamma voltage;

wherein the step of detecting current color temperature data of the background environment right behind the display comprises detecting and calculating the color temperature compensation coefficient of the display in advance, which comprises the following step:

detecting first color temperature data of the background environment which is obtained through light that does not transmit through the display;

detecting second color temperature data of the background environment which is obtained through light that transmits through the display;

determining the color temperature compensation coefficient according to the first color temperature data of the background environment and the second color temperature data of the background environment; and storing the color temperature compensation coefficient.

2. The color temperature adjustment method according to claim 1, wherein before the step of detecting the current color temperature data of the background environment right behind the display further comprises:

receiving a mode selection with respect to the display, wherein the mode selection comprises a display mode and a transparent mode;

obtaining a predetermined gamma voltage and a fixed color temperature of the display when the display mode is selected;

detecting the current color temperature data of the background environment right behind the display when the transparent mode is selected.

3. The color temperature adjustment method according to claim 1, wherein the color temperature data of the background environment comprises R/G/B three color characteristic data of the background environment.

4. The color temperature adjustment method according to claim 1, wherein in the step of determining the color temperature compensation coefficient according to the first color temperature data of the background environment and the second color temperature data of the background environment, the color temperature compensation coefficient is obtained by calculating a ratio of the first color temperature data of the background environment to the second color temperature data of the background environment.

5. An electronic device, comprising:

a memory storage, a processor, an environment light detector, a display, and one or more display color temperature adjustment program stored in the memory storage;

wherein the display is a transparent display, and the display color temperature adjustment programs are configured to be executed by the processor for:

detecting current color temperature data of a background environment right behind a display;

obtaining a color temperature compensation coefficient of the display;

calculating a target color temperature of the display according to the color temperature data of the background environment and the color temperature compensation coefficient;

obtaining a gamma voltage corresponding to the target color temperature;

controlling the display to adjust the color temperature of the display to the target color temperature according to the obtained gamma voltage, wherein the display color temperature adjustment programs are further configured to be executed by the processor for:

detecting first color temperature data of the background environment which is obtained through light that does not transmit through the display;

detecting second color temperature data of the background environment which is obtained through light that transmits through the display;

determining the color temperature compensation coefficient according to the first color temperature data of the background environment and the second color temperature data of the background environment;

storing the color temperature compensation coefficient.

6. The electronic device according to claim 5, wherein the display color temperature adjustment programs are further configured to be executed by the processor for:

receiving a mode selection with respect to the display, wherein the mode selection comprises a display mode and a transparent mode;

obtaining a predetermined gamma voltage and a fixed color temperature of the display when the display mode is selected;

detecting the current color temperature data of the background environment right behind the display when the transparent mode is selected.

* * * * *